US006301782B1

(12) United States Patent
Jacks, Jr.

(10) Patent No.: US 6,301,782 B1
(45) Date of Patent: Oct. 16, 2001

(54) APPARATUS AND METHOD FOR CONTROLLING ANGULAR RELATION BETWEEN TWO ROTATING SHAFTS

(76) Inventor: Morris G. Jacks, Jr., P.O. Box 186, Vidor, TX (US) 77662

( * ) Notice: Subject to any disclaimer, the term of this patent is extended or adjusted under 35 U.S.C. 154(b) by 0 days.

(21) Appl. No.: 09/588,789

(22) Filed: Jun. 6, 2000

Related U.S. Application Data

(62) Division of application No. 09/251,520, filed on Feb. 17, 1999, now Pat. No. 6,093,009.

(51) Int. Cl.[7] ..... B21D 53/28; B23P 6/00

(52) U.S. Cl. ..... 29/893.1; 29/893.2; 29/888.021; 29/402.08

(58) Field of Search ..... 29/893.1, 893.2, 29/888.021, 402.03, 402.08

(56) References Cited

U.S. PATENT DOCUMENTS

| | | | | |
|---|---|---|---|---|
| 601,990 | * | 4/1898 | Suyer . | |
| 1,579,983 | * | 3/1926 | Gossett . | |
| 2,932,207 | * | 4/1960 | Whitney | 74/447 |
| 3,168,836 | * | 2/1965 | Militana . | |
| 3,383,756 | * | 5/1968 | Smirl | 29/893.2 |
| 3,501,973 | * | 3/1970 | Casale | 74/395 |
| 3,541,871 | * | 11/1970 | Burrell | 74/447 |
| 3,577,795 | * | 5/1971 | Bennett | 29/893.2 |
| 4,286,476 | * | 9/1981 | Stiff | 74/395 |
| 5,181,432 | * | 1/1993 | Allen | 74/395 |

OTHER PUBLICATIONS

Sier–Bath Twin Screw Pumps Instruction Manual, Worthington Dresser, pp. 1–28, 2166–EI–8606, Worthington Pump Division, Bradford, Ontario, Canada.*

* cited by examiner

*Primary Examiner*—P. W. Echols
(74) *Attorney, Agent, or Firm*—Gary L. Bush; Mayor, Day, Caldwell & Keeton, LLP

(57) ABSTRACT

The timing gear device or structure (26) has a pair of timing gears (28, 30) mounted on parallel rotating shafts (22, 24). Each timing gear (28, 30) has an outer gear portion (32) and a concentric interfitting inner gear portion (34). Outer gear portions (34) have teeth (48) which intermesh to transmit torque from drive shaft (22) to driven shaft (24). Each concentric inner gear portion (34) has longitudinally extending splines (44) in meshing relation with splines (46) on the inner periphery of outer gear portion (32). As shown in particular in FIGS. 5–8, the timing gears can be replaced by timing structure (26) by angular alignment or indexing of driven shaft (24) with inner gear portion (34) secured thereto while outer concentric gear portion (32) is removed. For indexing, drive shaft (22) is fixed and timing gear (28) is mounted thereon by key (40). After indexing driven shaft (24) at a precise angular relation to drive shaft (22), outer concentric gear portion (32) for shaft (24) is slipped over inner gear portion (34) as shown particularly in FIG. 5 with splines (44) on inner gear portion (34) intermeshing with splines 46 on outer gear portion (32).

5 Claims, 4 Drawing Sheets

APPARATUS AND METHOD FOR CONTROLLING ANGULAR RELATION BETWEEN TWO ROTATING SHAFTS

This application is a divisional of application Ser. No. 09/251,520 filed on Feb. 17, 1999 now U.S. Pat. No. 6,093,009.

FIELD OF THE INVENTION

This invention relates to an apparatus and method for controlling the angular relation between two parallel rotating shafts, and particularly to such an apparatus and method in which timing gears are mounted on the rotating shafts in an interfitting relation to provide a precise angular relation between the rotating shafts.

BACKGROUND OF THE INVENTION

Heretofore, interfitting timing gears have been provided on parallel rotating shafts to provide a precise angular relation between a drive shaft and a driven shaft as required for the operation of various devices, such as twin screw pumps, for example. A key on each shaft normally fits in an aligned elongate keyway in the internal bore of the associated timing gear for mounting the timing gear at a precise angular position on the shaft. Thus, the timing gears are easily mounted initially at a precise angular position on each shaft. However, after prolonged periods of use or undue wear, it is necessary to replace the timing gears, and the timing gears must be positioned on the shaft at a precise angular relation within a tolerance of about 0.001 inch for each 0.004 inch of circumference for twin screw pumps, for example.

For replacement of the timing gears, the worn timing gears are removed from the shafts upon longitudinal movement of the keyways in the gears relative to the keys on the shafts. Upon replacement of the timing gears, one of the timing gears is keyed to a shaft at a predetermined angular relation. The other timing gear for precise angular alignment has a keyway cut thereon at a precise angular relation on the shaft, but oftentimes the keyway is not cut at the precise location, thereby resulting in an improper timed position. Timing gears have been utilized on twin screw pumps which are single stage, positive displacement pumps used to transfer oil or other liquids of varying viscosities. The flow of liquid through the pump is accomplished by the progressive movement of sealed cavities formed by the intermeshing of matching pumping screws (one right hand and one left hand) rotating in the precision ground bores of the pump body. The key assembly of the screw pump is the rotating element. Each rotating element consists of a drive shaft and a driven shaft extending along parallel axes at a fixed center distance. Each shaft includes bearings, one timing gear and two opposing pumping screws plus mounting hardware. Some designs have pinned screws mounted on shafts, and others have the screws and shafts as an integral piece.

For proper operation, precise clearances are maintained between meshing screws to limit the internal leakage (slip) in the pump. The majority of two rotor, or two shaft pumps use timing gears. Timing gears are used to maintain these clearances, prevent contact between the pumping screws, and turn the driven shaft.

Timing gears currently in use are one part gears, and can be worm, spur, herringbone or helical gears, depending on the pump manufacturer. Replacement of these gears requires the complete removal of both rotating shaft assemblies from the pump, and requires the service of a precision machine shop to replace these gears. the timing gears are pressed into the shafts, and have keyways to prevent their rotation.

If new timing gears are to be installed on the rotating elements they must be timed before key-slotting. Spare gears are supplied in matched pairs with one key slotted and one not key-slotted. The reason for this is that the timing gear position on the shaft determines the critical clearance between pumping screws. In the average screw pump the change in clearance between the meshing screws is about 0.001 inch for each 0.004 inch distance in circumference at the pitch diameter of the timing gear. Since the normal axial clearance of meshing screws varies with the size of the pump and the viscosity of the fluid that the pump was designed for, very accurate key-slotting is essential for proper operation. The original screw clearances are stamped on the pump body at the bracket flange. This number represents total clearance. One half of it is the proper axial distance between the meshing screw threads.

For replacement, the old timing gears are removed from the shafts and the new gears are pushed half way onto their shaft diameter. The key is then placed in the slotted gear and the rotating elements are intermeshed. The free timing gear is adjusted until the desired screw clearance is obtained. The timing gears are then pushed into their final position and clearances are checked. If satisfactory, the rotating element is replaced in the body and the pump is reassembled without the stuffing box packing. The pump should now turn freely by hand. If not, check and repeat the above until proper results are obtained. When the results are satisfactory disassemble the pump. Check the screw clearances as before. If the clearances are correct, mark the timing gear from the key slot in the shaft. Then, cut the key slot in the gear with the greatest precision possible. Replace the gear with the key in place. Check the screw clearances as before. If satisfactory, assemble the pump and check for free rotation. If the key slot cut does not give the proper clearances, another key slot is cut to get proper results.

Unless the timing of screw pumps is done accurately, there is little point in doing it. However, periodic checks of the pump and replacement of timing gears as they wear are the best means of obtaining long service. Pump life may be extended three or more times by careful timing gear maintenance. If the timing gears are damaged suddenly (by foreign matter in the fluid being pumped) it is possible to effect temporary repairs by turning the gears on the shaft so the undamaged faces will be used.

It is an object of this invention to provide an apparatus and method for replacing interfitting timing gears on a pair of parallel shafts without the necessity of cutting a new keyway or key slot in one of the timing gears in order to provide a precise angular relation between the shafts.

SUMMARY OF THE INVENTION

The present invention is particularly directed to a timing gear arrangement for a pair of parallel shafts including a timing gear on each of the shafts. The parallel shafts comprise a drive shaft and a driven shaft. Each timing gear has an outer gear portion and an inner concentric gear portion fitting within the bore of the outer gear portion and keyed on an associated shaft. The inner gear portion is arranged for relative rotational adjustment on the outer gear portion to permit precise angular adjustment of the shafts without cutting of a keyway or slot in one of the timing gears during the replacement of the timing gears. The outer gear portions have outer meshing gear teeth for rotation of the driven shaft from the drive shaft.

The outer peripheral surface of the inner gear portion and the inner peripheral surface of the outer concentric gear portion have interfitting members, such as splines, to permit relative rotative adjustment between the inner and outer gear portions when the interfitting members on the gear portions are disengaged. Thus, the position of the keyway or key slot in the inner gear portion is not critical since the inner gear portion can be rotated or adjusted angularly relative to the outer gear portion to provide a precise angular relation between the drive shaft and driven shaft. Thus, the keyway can be cut on the inner gear portion prior to replacement of the timing gears. During replacement, the inner gear portions can be immediately keyed to the drive shaft and driven shaft prior to the adjustment of the angular relationship between the shafts. The interfitting members between the inner gear portion and outer gear portion of each timing gear preferably comprises a plurality of interfitting splines to permit relative axial movement of the inner and outer gear portions.

For replacement of the timing gears for a twin screw pump on parallel drive and driven shafts and utilizing the present invention, a replacement timing gear including inner and outer gear portions is keyed onto the drive shaft. The drive shaft is fixed against rotation. Then, an inner gear portion of the other replacement timing gear is keyed to the driven shaft with the outer gear portion out of engaged position with the other timing gear and out of engaged position with the inner gear portion. Then the driven shaft is rotated in one direction until the twin screws on the pump abut. This position is marked with a scribe on the inner gear portion. Then the driven shaft is rotated in an opposite direction until the twin screws of the pump abut. This position is then marked with a scribe. The number of splines between the two scribe marks are counted and the driven shaft is rotated back for a distance equal to one-half the number of splines. At this position, the driven shaft is fixed against rotation, and the outer gear portion is moved axially into engagement with the splines on the inner gear portion and into meshed position with the teeth of the other outer gear portion on the drive shaft. The drive and driven shafts are now positioned in proper angular relation to each other. The number of splines on the inner concentric gear portion are predetermined in order to provide the desired tolerance for the pump screws.

Other features and advantages will be apparent from the following specification and drawings.

DESCRIPTION OF THE INVENTION

Figure 1:
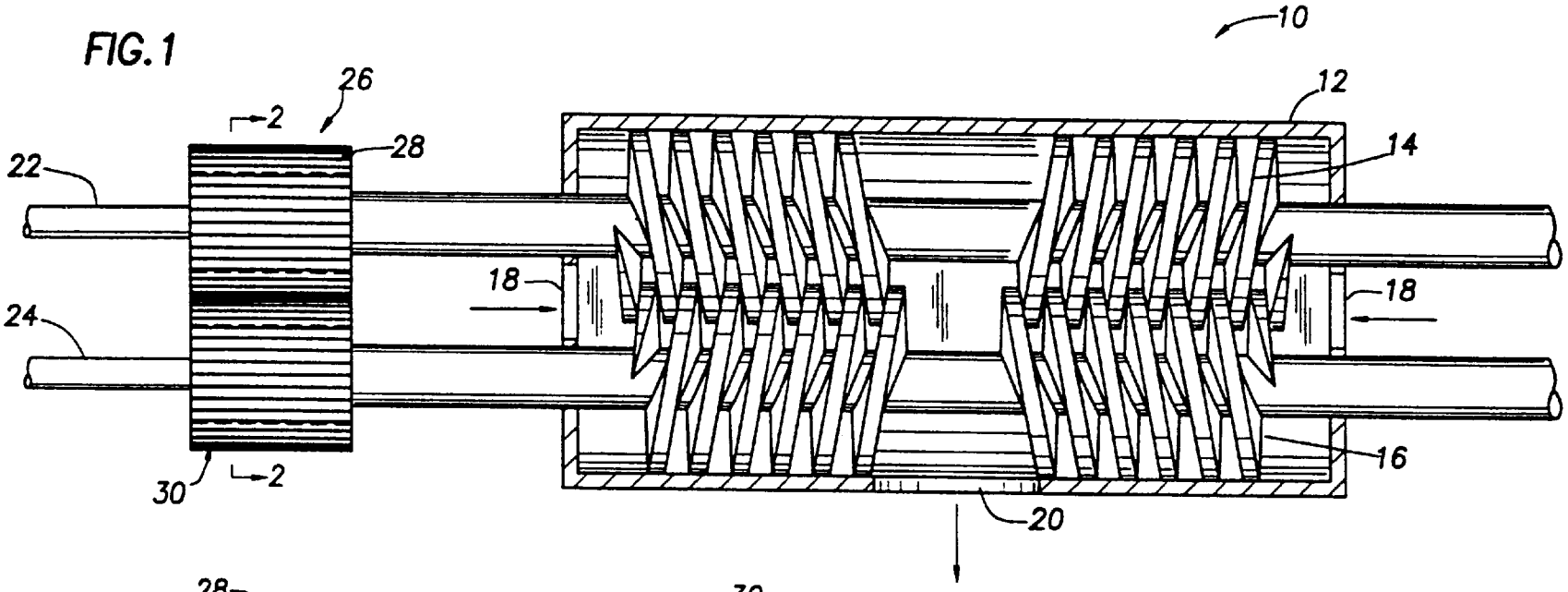
FIG. 1 is a plan view of an embodiment of the invention in which timing gears of the present invention are mounted on a pair of shafts for a twin screw pump.
Figure 2:
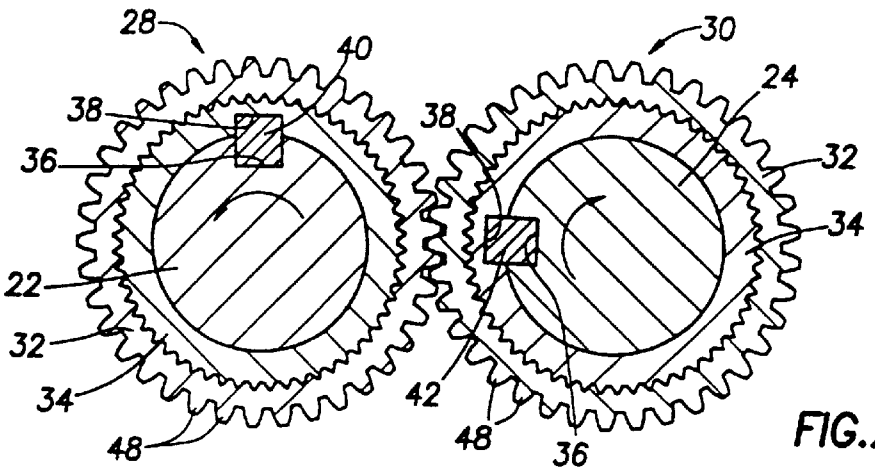
FIG. 2 is a section taken generally along line 2—2 of FIG. 1.
Figure 3:
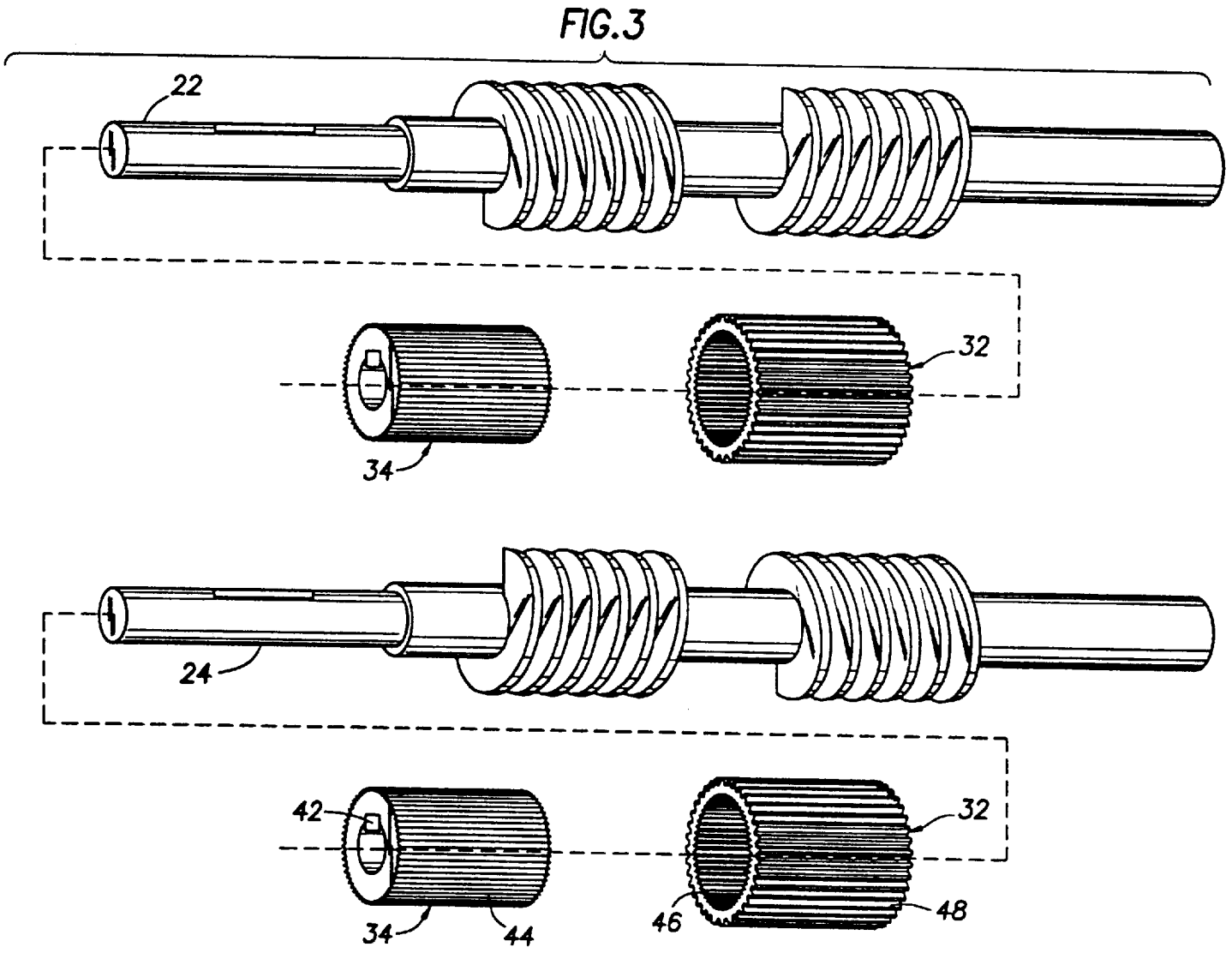
FIG. 3 is an exploded view of the timing gears and the parallel drive and driven shafts on which the timing gears are mounted.
Figure 4:
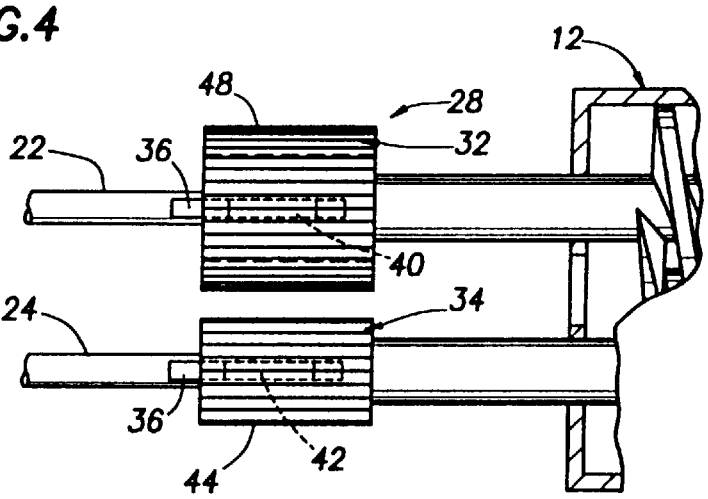
FIG. 4 is a top plan showing an initial step for replacement of timing gears with one timing gear keyed to a drive shaft and an inner timing gear portion of the other timing gear keyed to the driven shaft with the outer concentric gear portion of the other timing gear removed.

The timing gear structure or device of the present invention as shown in the drawings is being utilized with a twin screw pump generally indicated at 10 as an example. As shown particularly in FIG. 1, pump 10 comprises a single stage, positive displacement pump utilized to transfer oil or other liquids of various viscosities. A pump housing 12 encloses a pair of matching pumping screws or worms 14, 16 therein rotating in opposite directions. An inlet 18 for the liquid material is provided on one side of housing 12 and an outlet 20 is provided along another side of housing 12. Pump screw 14 is mounted on drive shaft 22 for rotation in one direction and pump screw 16 is mounted on driven shaft 24 for rotation in an opposite direction. Drive shaft 22 and driven shaft 24 are mounted in bearings in a parallel relation to each other. A suitable twin screw pump is sold by Worthington Canada Inc. of Brantford, Ontario, Canada.

To maintain a precise clearance between meshing screws 14, 16 on shafts 22, 24 which is required for proper operation, a precise angular position between shafts 22, 24 must be obtained and maintained. For this purpose, a timing gear structure or device forming the present invention is generally indicated at 26. Gear device 26 is also effective for transferring torque from drive shaft 22 to driven shaft 24 for rotation of driven shaft 24.

Timing gear device 26 has a timing gear generally indicated at 28 on drive shaft 22 and a timing gear generally indicated at 30 on driven shaft 24. Timing gears 28 and 30 are generally identical and each has an outer gear portion 32 and an inner concentric gear portion 34 received within the bore of outer gear portion 32. A keyway or slot 36 is positioned in each shaft 22, 24 and an aligned keyway or slot 38 is positioned in each inner gear portion 34. A key 40 is mounted in keyways 36, 38 for drive shaft 22 and inner gear portion 34. A key 42 is mounted in keyways 36, 38 for driven shaft 24 and inner gear portion 34 to mount inner gear portion 34 for rotation with shafts 22, 24.

Outer gear portion 32 and inner concentric gear portion 34 are connected to each other by intermeshing longitudinal extending splines 44 on the outer periphery of inner gear portion 34 and splines 46 on the opposed inner periphery of outer gear portion 32. Outer gear portion 32 may easily move longitudinally along inner gear portion 34 on splines 44 when not fixed. The outer peripheries of outer gear portion 32 on shaft 22 and outer gear portion 32 on shaft 24 have a plurality of longitudinal extending teeth 48 for intermeshing. Torque from drive shaft 22 is transferred to shaft 24 through the outer interfitting teeth 48 on outer gear portions 32.

Since timing gears 28 and 30 are formed of two concentric portions or components comprising outer gear portion 32 and inner gear portion 34, one timing gear may be easily replaced without cutting of a keyway in one of the timing gears at a precise angular position between the parallel shafts in order to obtain a desired pitch or spacing between rotated screws or worms, for example. One shaft may be indexed or positioned angularly relative to the other shaft by an inner gear portion keyed to the one shaft. Then, the outer concentric gear portion may be moved or slipped longitudinally over the inner gear portion in a meshing relation with splines on the inner gear portion and in a meshing relation with the teeth of a timing gear on the other shaft thereby eliminating the necessity of cutting a new keyway in a timing gear when worn timing gears are replaced.

Replacement of Timing Gears

Figure 5:
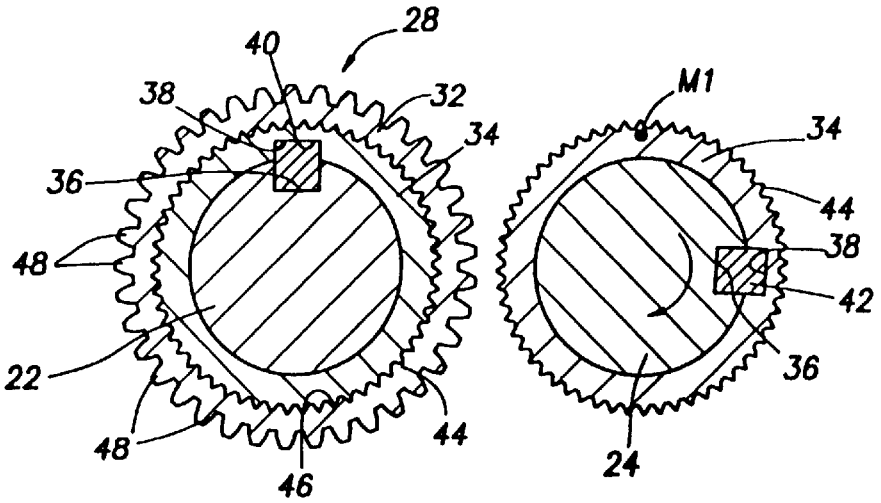
FIG. 5 shows schematically the next step of adjusting the angular position of the shaft by rotation of the driven shaft in one direction to an abutting position of the pump screws on the shaft while the drive shaft is fixed against rotation with the abutting position marked on the inner gear portion.
Figure 6:
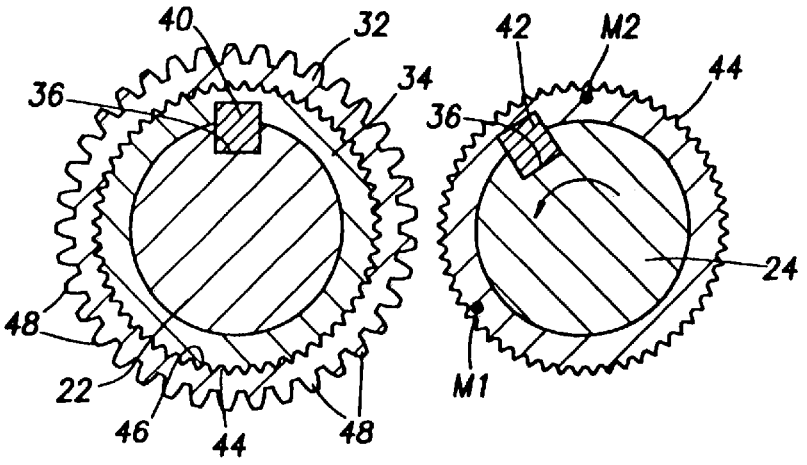
FIG. 6 illustrates schematically the next step of adjusting the angular position of the shafts by rotating the driven shaft in an opposite direction to an abutting position of the pump screws on the shafts while the drive shaft is fixed against rotation and with the position marked on the inner gear portion of the driven gear.
Figure 7:
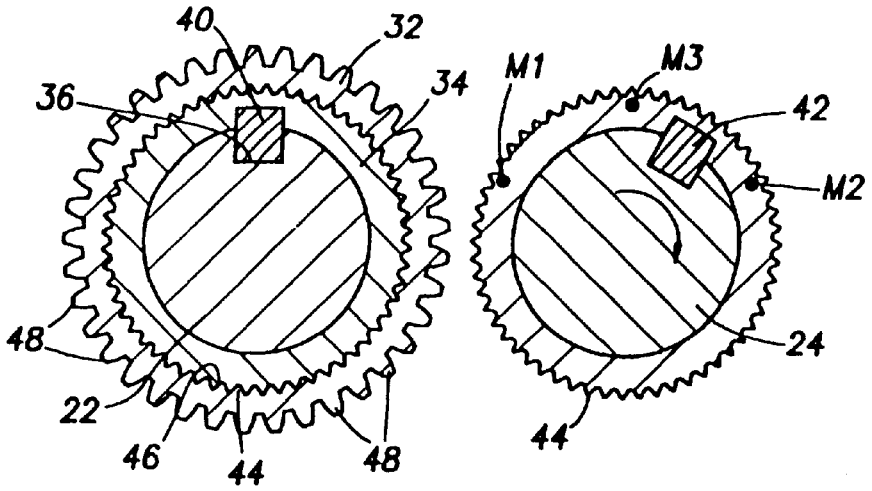
FIG. 7 illustrates schematically a further step of rotating the driven shaft back one half the distance between the two marks at which position the driven shaft is fixed at the proper angular relation to the drive shaft.
Figure 8:
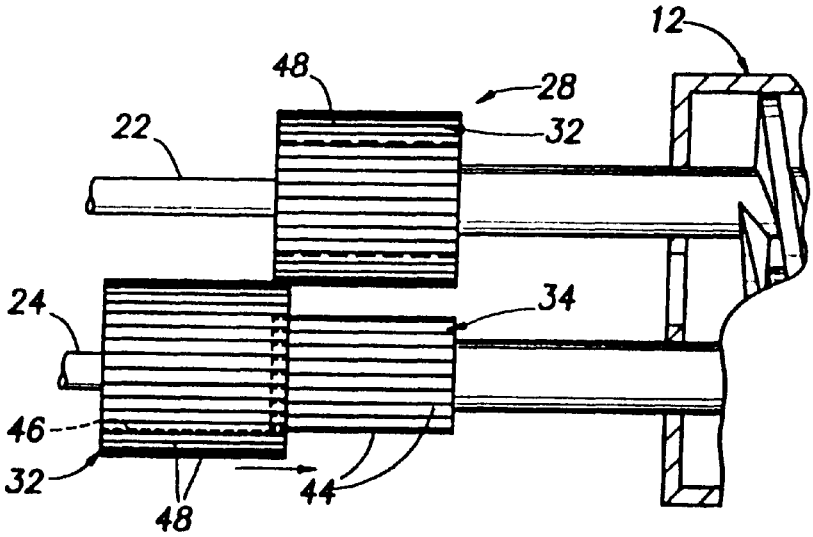
FIG. 8 illustrates schematically the final step of adjusting the angular position of the shafts in which the outer concentric timing gear portion for the driven shaft is moved longitudinally into an interfitting meshing relation with the inner timing gear portion on the driven shaft and into a meshing relation with the outer timing gear portion on the drive shaft.

For replacement of worn or defective timing gears found on a pair of parallel rotating shafts, the defective timing gears are removed from the shafts by removal of the keys from the associated keyways of the timing gears and shafts. The following replacement steps are now taken in sequence with the present invention:

1. Keying inner timing gear portions 34 to shafts 22 and 24 by the insertion of keys 40 and 42 in keyways 36, 38 thereby to mount inner gear portions 34 on drive shaft 22 and driven shaft 24.
2. Sliding outer gear portion 32 onto the splines 44 of concentric inner gear portion 34 for drive shaft 22 as shown in FIG. 5.
3. Fixing drive shaft 22 against rotative movement to secure drive shaft 22 in a fixed position for the remaining replacement steps.
4. Rotating driven shaft 24 in a clockwise direction as shown in FIG. 5 until the screws 14 and 16 on shafts 22 and 24 abut each other and marking this location with a scribe at M1 as shown in FIG. 5.
5. Then rotating driven shaft 24 in a counter-clockwise direction as shown in FIG. 6 until screws 14 and 16 abut each other in an opposite direction and marking this position with a scribe at M2 as shown in FIG. 6.
6. Counting the number of splines 44 between marks M1 and M2 and dividing this number by 2.
7. Then rotating driven shaft 24 back in a clockwise direction for one-half the number of splines counted between marks M1 and M2 to a position shown in FIG. 7 in which mark M3 is shown halfway between marks M1 and M2.
8. Fixing driven shaft 24 against rotation.
9. Then slipping outer gear portion 32 along shaft 24 onto inner gear portion 34 as shown in FIG. 8 with splines 44 and 46 in meshed relation and teeth 48 on outer gear portion 32 of driven shaft 24 in meshed relation with teeth 48 on the outer gear portion 32 of drive shaft 22.
10. Releasing drive shaft 22 and driven shaft 24 from a fixed rotational position.

The number of teeth 48 on the outer periphery of outer gear portion 32 and the number of splines 44 on inner gear portion 34 which intermesh with splines 46 on the inner periphery of outer concentric gear portion 32 is predetermined in order to obtain a desired tolerance or degree of accuracy. Generally, maximum effect is obtained by the use of a large number of splines 44 and 46 relative to the number of teeth 48. However, the splines 44 and 46 transmit the torque between drive shaft 22 and driven shaft 24 and must be of sufficient cross-sectional area in order to transmit the power or load capacity of the twin screw pump 10.

Figure 9:
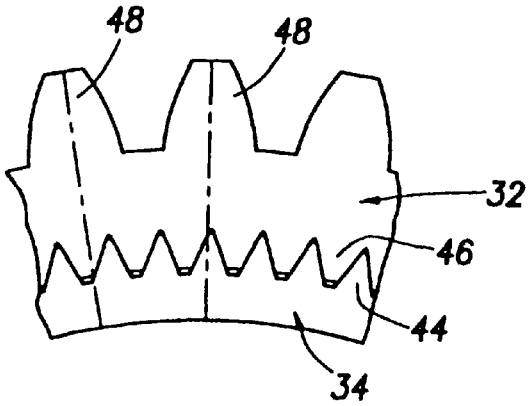
FIG. 9 is an enlarged sectional view of a portion of the splined connection between the outer periphery of an inner gear portion and the inner periphery of an outer gear portion illustrating the number of the splines relative to the outer teeth on the outer gear portions for obtaining the proper angular position between the drive shaft and driven shaft.

As an example of a twin screw pump which may be utilized with the present invention, the drive and driven shafts have a distance of 3.375 inches between centerlines. The outer diameter of each timing gear is 3.57 inches. Each gear portion 32 and 34 is formed with 77 splines and the possible number of combinations is 5929. Splines 44 on inner gear portion 34 as shown in FIG. 9 number 77, and splines 46 on outer gear portion 32, also number 77. The number of teeth 48 on outer gear portion 32 number 33. Dividing 360 degrees by 5929 results in an adjustment of 0.0017 inch which provides a tolerance between one (1) mil and two (2) mils. Various numbers of teeth 48 and splines 44, 46 could be provided dependent on the type of teeth, pitch type, and other factors.

From the foregoing, it is apparent that the present timing gear device utilizing a timing gear having an inner gear portion and an outer concentric gear portion provides major advantages. When utilized with a twin screw positive displacement pump, the new timing gear can be installed on a pump in place without having to remove any rotating shafts for transport to a machine shop for machining. The timing gears can be mass produced and stocked along with other associated parts. Further, in many instances only the outer gear portion 32 will be worn and the outer gear portion 32 can be replaced without the removal or replacement of inner gear portion 34 thereby simplifying the replacement of the timing gears. A new outer gear portion 32 can be easily installed over the old inner splined gear portion 34. Since keyways are not cut in the timing gear during replacement, the gear portions 32 and 34 can be hardened after the initial cutting of the keyway in the inner gear portion 34.

While the outer gear portion 32 is shown in the drawings as a spur gear comprising longitudinally extending teeth 48, the timing gear could be formed of spur, herringbone, or helical gears, for example, depending on the particular manufacturer of the twin screw rotary pump.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A method of replacing a pair of timing gears on a pair of parallel shafts for rotating said shafts in a precise timed relation to each other; said method comprising the following steps;

removing the timing gears from said shafts;

mounting a first replacement timing gear on a first shaft in fixed relation thereon;

providing a second replacement timing gear for the second shaft, the second replacement timing gear having a pair of concentric inner and outer timing gear portions;

providing cooperating members on the outer periphery of said inner gear portion and on the inner periphery of said outer gear portion for interfitting to permit relative longitudinal movement between said gear portions and to provide a rotational drive connection between said gear portions;

mounting said inner concentric gear portion on said second shaft in fixed relation thereon;

fixing said first shaft and timing gear thereon against rotation;

rotating said second shaft and inner concentric gear portion thereon to a precise angular relation relative to the fixed position of said first shaft, then fixing said second shaft against rotation; and then moving said outer gear portion longitudinally onto said concentric inner gear portion for interfitting of said cooperating members on said gear portions and for engaging said first timing gear in a rotational force transmitting relation.

2. The method as set forth in claim 1 includes the steps of:

providing longitudinally extending splines on the outer periphery of said inner gear portion and providing interfitting longitudinally extending splines on the inner periphery of said outer gear portion for permitting relative longitudinal movement between said gear portions.

3. The method as set forth in claim 1 including the steps of:

providing teeth on the outer periphery of said first timing gear and on the outer periphery of said outer gear portion of said second timing gear; and interfitting said teeth in an intermeshing relation for transmitting rotational forces.

4. The method as set forth in claim 2 including the steps of:

providing inner and outer concentric gear portions for said first timing gear; and keying the inner gear portions of said timing gears to said associated shafts for fixing said inner gear portions thereon.

5. The method as set forth in claim 3 including the step of:

providing at least twice the number of splines on the inner periphery of said outer gear portion as the number of teeth on the outer periphery of said outer gear portion to permit a precise angular position between the shafts.

* * * * *

UNITED STATES PATENT AND TRADEMARK OFFICE

CERTIFICATE OF CORRECTION

PATENT NO. : 6,301,782 B1
DATED : October 16, 2001
INVENTOR(S) : Morris G. Jacks, Jr.

It is certified that error appears in the above-identified patent and that said Letters Patent is hereby corrected as shown below:

Column 2,
Line 1, after the "." capitalize "The"

Column 6,
Line 13, remove the bold from "77"
Line 15, remove the bold from "77"
Line 16, remove the bold from "77"
Line 17, remove the bold from "33"

Signed and Sealed this

Twenty-fourth Day of December, 2002

JAMES E. ROGAN
*Director of the United States Patent and Trademark Office*